US008869704B2

(12) United States Patent
Eches et al.

(10) Patent No.: US 8,869,704 B2
(45) Date of Patent: Oct. 28, 2014

(54) SUB-CALIBER PROJECTILE WITH A FITTED HEAD STRUCTURE

(71) Applicant: Nexter Munitions, Versailles (FR)

(72) Inventors: Nicolas Eches, Vierzon (FR); Arnaud Guilloux, Saint Florent sur Cher (FR); Richard Roy, Bourges (FR)

(73) Assignee: Nexter Munitions, Versailles (FR)

( * ) Notice: Subject to any disclaimer, the term of this patent is extended or adjusted under 35 U.S.C. 154(b) by 0 days.

(21) Appl. No.: 13/785,393

(22) Filed: Mar. 5, 2013

(65) Prior Publication Data

US 2013/0340646 A1 Dec. 26, 2013

(30) Foreign Application Priority Data

Mar. 6, 2012 (FR) ..... 12 00677

(51) Int. Cl.
*F42B 12/06* (2006.01)
*F42B 14/06* (2006.01)
*F42B 12/08* (2006.01)

(52) U.S. Cl.
CPC ..... *F42B 14/068* (2013.01); *F42B 12/06* (2013.01); *F42B 12/08* (2013.01)
USPC ..... 102/521

(58) Field of Classification Search
USPC ..... 102/517, 518, 519, 520, 521, 522, 523
See application file for complete search history.

(56) References Cited

U.S. PATENT DOCUMENTS 1,102,758 A * 7/1914 Keen ..... 102/519
2,401,380 A * 6/1946 Teitscheid ..... 102/519
3,033,116 A * 5/1962 Critcher et al. ..... 102/521
4,075,946 A * 2/1978 Deffayet et al. ..... 102/518
4,559,876 A * 12/1985 Bocker et al. ..... 102/520
4,643,099 A * 2/1987 Luther et al. ..... 102/517
4,665,828 A * 5/1987 Auer ..... 102/519
4,708,064 A 11/1987 Bisping et al.

(Continued)

FOREIGN PATENT DOCUMENTS

DE 3736167 A1 * 5/1989 ..... F42B 12/06
DE 40 22 462 A1 1/1992

(Continued)

OTHER PUBLICATIONS

Preliminary Search Report issued in French Patent Application No. 1200677 dated Nov. 13, 2012 (with translation).

(Continued)

*Primary Examiner* — Bret Hayes
(74) *Attorney, Agent, or Firm* — Oliff PLC

(57) ABSTRACT

An arrow-type sub-caliber projectile has a piercing bar which is cylindrical about a longitudinal axis, extended by a conical portion, and is surrounded by a sabot made of a lightweight material and allows the firing of the projectile in a weapon. This conical portion has a tip of a heating-resistant material with a maximum diameter less than half the diameter of the bar, the tip being connected to the bar by a support structure having no ballistic effects, the bar having a flat front face which is perpendicular to the longitudinal axis of the bar, the flat front face area being substantially equal to the cross-sectional area of the bar, thus with no element with ballistic effects interposed between the flat front face of the bar and the tip.

6 Claims, 4 Drawing Sheets

(56) References Cited

U.S. PATENT DOCUMENTS

| | | | | |
|---|---|---|---|---|
| 4,724,769 | A | 2/1988 | Luther et al. | |
| 4,736,686 | A * | 4/1988 | Martin | 102/351 |
| 4,770,102 | A * | 9/1988 | Bisping et al. | 102/521 |
| 5,103,735 | A * | 4/1992 | Kaste et al. | 102/521 |
| 5,223,667 | A * | 6/1993 | Anderson | 102/517 |
| 5,728,968 | A * | 3/1998 | Buzzett et al. | 102/364 |
| 6,662,726 | B1 * | 12/2003 | Steiner | 102/521 |
| 2004/0231552 | A1 | 11/2004 | Mayersak | |
| 2005/0109233 | A1 | 5/2005 | Eches et al. | |

FOREIGN PATENT DOCUMENTS

| | | | | |
|---|---|---|---|---|
| DE | 4023482 | A1 * | 1/1992 | F42B 12/06 |
| EP | 1 521 052 | A1 | 4/2005 | |
| EP | 2 372 296 | A1 | 10/2011 | |
| FR | 2 521 717 | A1 | 8/1983 | |
| FR | 2 578 045 | A1 | 8/1986 | |
| FR | 2 661 739 | B1 | 7/1994 | |
| FR | 2 771 496 | A1 | 5/1999 | |
| FR | 2 842 897 | B1 | 9/2004 | |
| IL | 157066 | B | 2/2012 | |

OTHER PUBLICATIONS

Written Opinion issued in French Patent Application No. 1200677 dated Nov. 13, 2012 (with translation).

* cited by examiner

SUB-CALIBER PROJECTILE WITH A FITTED HEAD STRUCTURE

CROSS REFERENCE TO RELATED APPLICATIONS

Applicant claims priority under 35 U.S.C. 119 of French patent application no. 12-00677 filed on Jun. 3, 2012.

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC

Not Applicable

BACKGROUND OF THE INVENTION

1. Field of the Invention

The technical field of the invention is that of sub-caliber projectiles and in particular of armor-piercing discarding sabot-type sub-caliber projectiles of a large caliber (caliber greater than 75 mm).

2. Description of the Related Art

Sub-caliber projectiles (or arrow projectiles) are well known. They are constituted of a piercing-material bar, provided with a conical front portion, and carrying a stabilizing fin.

The bar has a caliber much smaller than that of the weapon that fires the projectile (25 to 30 mm diameter bar for a 120 mm caliber weapon).

The shot is made possible by means of a sabot to the caliber of the weapon that releases the bar at the exit of the tube of the weapon.

This conventional configuration allows to obtain a particularly high bar speed (of the order of 1700 m/s for an arrow bar fired by a 120 mm caliber weapon). Patents U.S. Pat. No. 4,724,769 and FR2842897 describe by way of example known arrow projectiles.

The great speed which is communicated to them gives the bars a very high capacity for piercing armors.

One of the main problems encountered by sub-caliber projectiles is that of the perforation reduction related to an impact on the target with an incidence (impact at an angle of the projectile with the target different from 90°).

In fact, known projectiles mostly comprise a head structure comprising one or more piercing nuclei of a diameter smaller than that of the bar itself. Patents U.S. Pat. No. 4,724,769 and FR2578045 show such a conventional head structure.

However, these nuclei located at the head have the effect of causing, upon impacting on a homogeneous target, an enlarged diameter crater which has a choke of a reduced diameter at its entry.

The diameter of the choke is substantially equal to the diameter of the bar while the diameter of the crater may be twice that of the bar.

An oblique impact will therefore cause an interference between the bar and the edge of the choke which results in a disturbance of the bar, thereby reducing its piercing performances.

Furthermore, from patent EP1521052 is known a bomb or missile warhead comprising a penetrating body of a large diameter (greater than 100 mm) and enclosing an explosive charge. This penetrating body carries at its front portion inserts of a dense material (e.g., tungsten alloy) which facilitate the target lock. Such a body is very different from an arrow-type sub-caliber projectile as provided by the invention. It does not comprise a sabot for firing by a weapon tube and its striking velocity on a target is of the order of 500 meters per second. The choke phenomena of the target upon impact do not occur at these reduced velocities.

The arrow sub-caliber projectiles concerned by the invention are fired by a weapon tube by barrel effect and have a striking velocity on a target of about 1700 meters per second.

BRIEF SUMMARY OF THE INVENTION

The aim of the invention is to provide an arrow-type sub-caliber projectile with a fitted head structure that imparts it with a piercing ability which is little reduced by oblique impacts.

Thus, the invention relates to an arrow-type sub-caliber projectile comprising a piercing bar extended by a conical portion, and surrounded by a sabot made of a lightweight material and allowing the firing of the projectile in a weapon, the projectile being characterized by the fact that the conical portion comprises a tip of a heating-resistant material with a diameter less than half the diameter of the bar, the tip being connected to the bar by a support structure having no ballistic effects, the bar comprising a flat front face substantially to the diameter of the bar.

According to a particular embodiment, the support structure comprises a block of a plastic or ceramic material.

According to another embodiment, the support structure comprises an aluminum conical tubular sleeve.

According to another embodiment, the support structure may comprise a foot connecting the tip to a middle portion of the front face of the bar, the foot having a diameter less than a quarter of the diameter of the bar.

The foot may be surrounded by a tube of a plastic or ceramic material.

BRIEF DESCRIPTION OF THE SEVERAL VIEWS OF THE DRAWING

The invention will be better understood upon reading the following description of various embodiments, description made by reference to the appended drawings, in which.

DETAILED DESCRIPTION OF THE INVENTION

Figure 1:
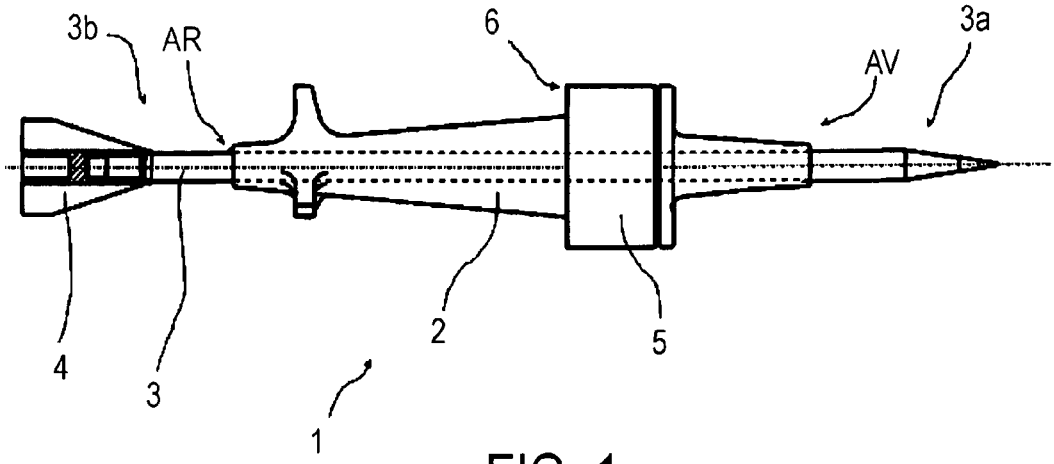
FIG. 1 Prior Art
FIG. 1 shows the general architecture of an arrow-type sub-caliber projectile.

FIG. 1 shows an arrow projectile 1 which comprises in a conventional manner a sabot 2 made of a lightweight material (such as an aluminum alloy), the sabot being formed of several segments and surrounding a sub-caliber bar 3.

The bar is made of steel or of a dense tungsten-based alloy.

The bar has a conical front portion 3*a* and carries at its rear part 3*b* a fin 4 ensuring its stabilization on trajectory.

The sabot bears a belt 5, made of a plastic material, and which ensures sealing of the propelling gases upon firing in the tube of a weapon (not shown).

Upon firing, the gases of the propelling charge (not shown) exert their thrust at a rear portion 6 of the sabot which is to the caliber and which constitutes the so-called thrust plate.

Such a general configuration of a fin-stabilized sub-caliber projectile (arrow projectile) is well known. Patents FR2521717 and FR2661739 which describe known arrow projectiles will be especially taken into account.

The sabot 2 is for allowing the firing of the projectile in the weapon. It consists of several segments (most of the time three) which surround the bar 3 and which are in contact two by two at joint planes.

At the exit of the weapon tube, the segments of the sabot 2 deviate from the bar 3 under the action of the aerodynamic pressure which exerts at the front portion (AV) of the sabot 2.

The deviation of the segments results in breaking of the belt 5 and the sabot therefore releases the bar 3 which continues its trajectory.

Shape matching means (not shown), e.g., a thread, are interposed between the sabot 2 and the bar 3 for driving the latter.

Figure 2:
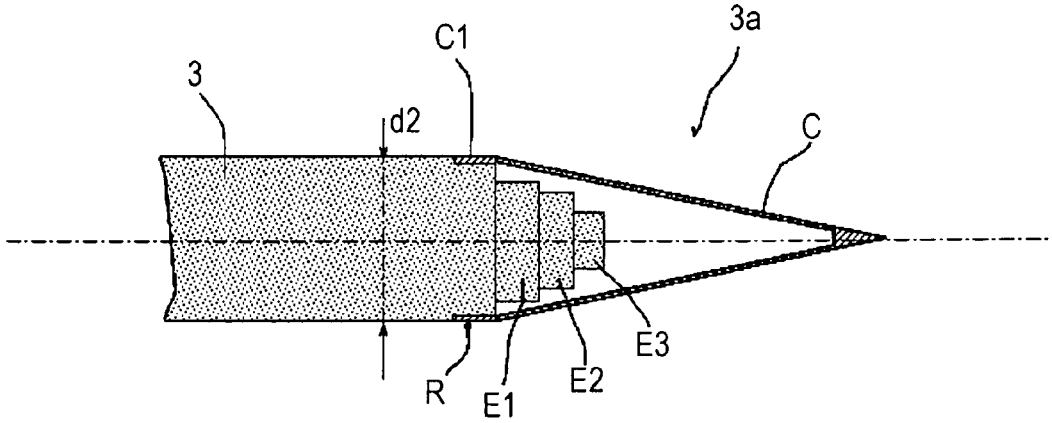
FIG. 2 Prior Art
FIG. 2 shows a head structure of a projectile according to the prior art.

FIG. 2 shows in more detail an examplary embodiment of a conical front portion 3*a* of the bar 3 for a projectile according to the prior art.

This front portion is formed by a conical cap C which is made, e.g., of steel to be able to withstand the heating on trajectory. The cap has a cylindrical extension C1 which positions on a choke R made at the front end of the bar 3.

It can be noted that the bar 3 is extended by several cylindrical portions E1, E2, E3, the diameter of which gradually decreases from the bar 3 to the front of the cap C. This conventional structure is taken to facilitate a progressive fragmentation of the head structure upon impact on a target. This is described particularly in patent FR2578045.

Figure 3:
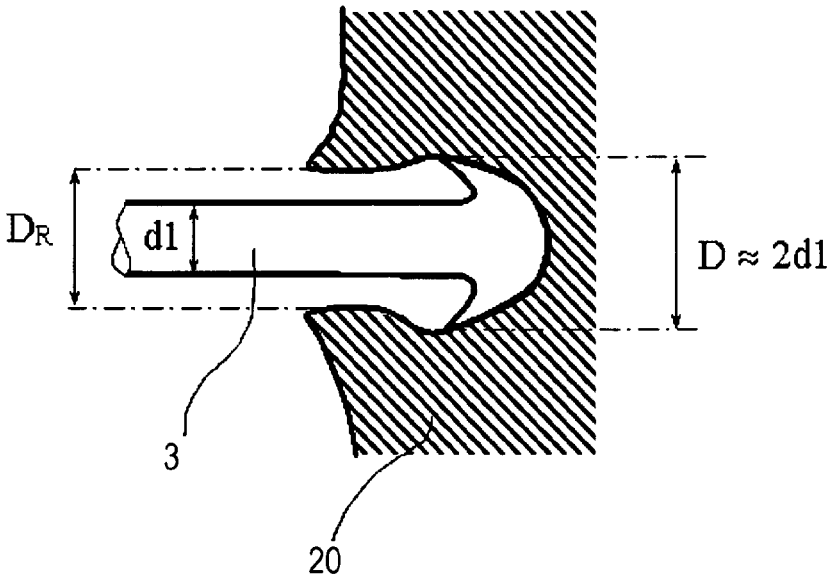
FIG. 3 Prior Art
FIG. 3 shows the impact on a target of such a head structure according to the prior art.

FIG. 3 shows the effect of the impact of such a projectile on a target 20. The warhead C is destroyed upon impact and the stack E1, E2, E3 creates a lead hole with a diameter $D_R$ which is slightly greater than the diameter d1 of the bar 3. The head of the bar expands within the target and creates a hole the diameter D of which is substantially equal to twice that of the bar d1 (D≈2d1). There is therefore, with the projectile according to the prior art, a choke $D_R$ at the entrance of the hole in the target, the choke causing disturbances when the target is impacted with an incidence (angle between the direction of the bar and the plane of the target different from zero).

Figure 4:
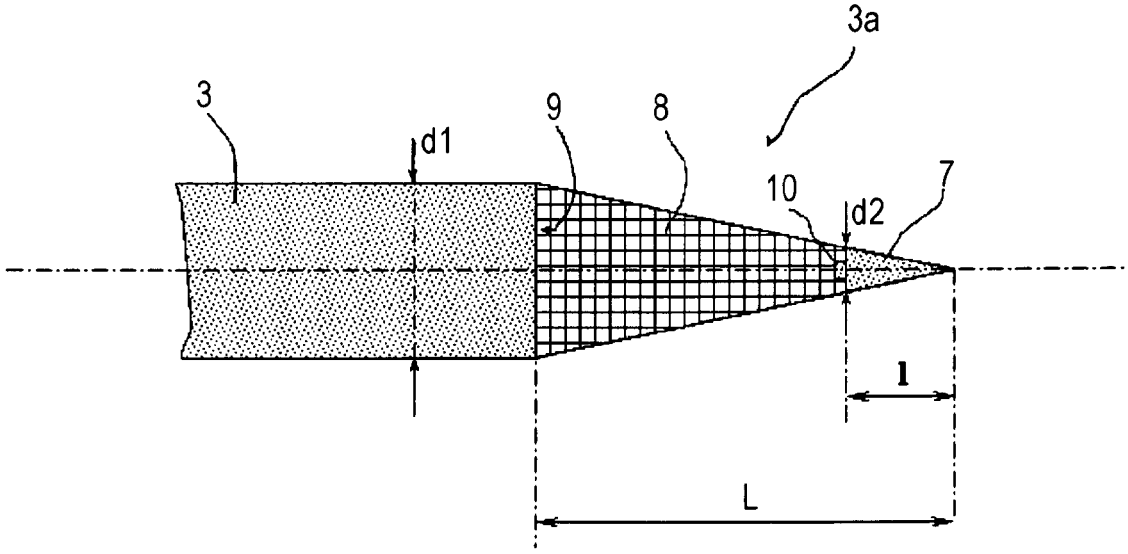
FIG. 4 shows a head structure of a projectile according to a first embodiment of the invention.

FIG. 4 shows a first embodiment of the invention.

According to this embodiment, the conical portion 3*a* has a tip 7 which is made of a material resistant to the heating on trajectory of the projectile, e.g., of steel or else of a material identical to that of the bar 3, such as a tungsten alloy. The tip 7 may also be made of a metal or a ceramic having a melting temperature greater than 1700 K.

This tip 7 has a maximum diameter d2 which is less than half the diameter d1 of the bar. It extends over a length 1 which is between 20% and 50% the total length L of the conical portion 3*a*.

The tip 7 is connected to the bar 3 by a lightweight structure which is herein formed by a block 8 of a plastic material.

The block 8 is fixed (herein by gluing) at a flat front face 9 of the bar 3. The tip 7 is fixed to the block 8, herein by crimping. To this end, the tip 7 bears a cylindrical lug 10 which accommodates into a corresponding hole of the block 8.

The tip 7 has the function of ensuring the heating resistance of the conical portion 3*a* during the ballistic trajectory of the bar 3. Its piercing efficiency has no importance. Yet, the resistance to the thermal stresses related to the flight, leads to select, in order to make the tip 7, a high melting point material (melting temperature greater than 1700 K), e.g. steel or else a tungsten alloy, or a ceramic.

Figure 5:
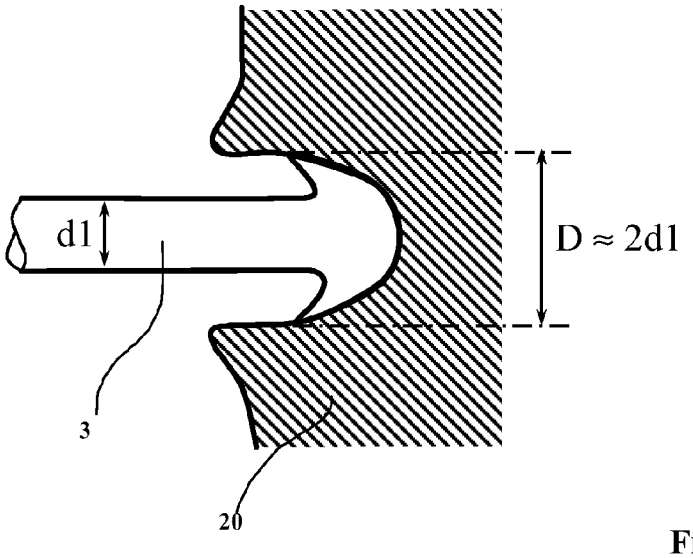
FIG. 5 shows the impact on a target of a head structure according to the invention.

FIG. 5 shows this projectile upon impact on a target 20. Since the diameter of the tip 7 is less than half the diameter d1 of the bar, the expansion of the hole progressively caused by the tip does not exceed half of d1. The bar will then be able to impact the target 20 by its flat front face 9.

Upon impact on the target, the tip 7 thus generates a pre-crater of a diameter substantially equal to that of the tip (d2) and the block 8 is destroyed. Only the bar 3 has a piercing effect on the target. Its flat front face 9 and its diameter d1 lead to the creation of a cavity the diameter of which will be substantially twice that (dl) of the bar.

From the ballistic performance point of view, the block 8 is nonexistent and the projectile acts as if it was constituted of two distinct portions consecutively impacting the target: the tip 7 and the bar 3. Saying that the block has no ballistic effects means it does not participate in the perforation.

This operation remains the same as long as the tip 7 has a diameter less than half the diameter d1 of the bar.

If the tip has a diameter between 0.5d1 and d1, it could be observed and simulated that the crater generated by the impact of the bar 3 itself has a diameter between d1 and 2d1, therefore has an entry choke $D_R$ which is detrimental to the perforation if the projectile has an incidence with respect to the target.

Contrary to the teaching of the prior art documents, it is therefore not necessary, in order to design an arrow projectile, to provide a conical head structure with a piercing ability. It is not necessary either to make a complex head structure comprising several piercing nuclei of gradually increasing diameters.

The head structure of the projectile according to the invention only has, at the tip of the front conical portion 3*a,* a member (tip 7) ensuring the thermal shock resistance occurring during the flight.

This resisting element must be as small as possible and must not hinder the impact of the flat front face 9 of the bar 3 itself on the target. This is why the structure connecting this resisting tip 7 to the bar 3 must also be as light as possible.

The piercing performances are ensured by the bar 3 alone the front flat portion 9 of which is to the diameter d1 of the bar. The conical portion 3*a* at the front of the bar does not participate in the perforation and must be removed upon impact not to disturb the action of the bar.

Therefore, in order to make the support structure 8, a material without any particular piercing abilities will be selected, e.g. a plastic material, such as polytetrafluoroethylene or another polymer.

It will also be possible to make the support structure 8 in a ceramic, such as aluminum nitride which has a very good heat resistance and is easily machinable. The heating of the support 8 is less than that undergone by the tip 7 itself. It will therefore be sufficient to select, for the support 8, a material with a melting point greater than 200° C.

Figure 6:
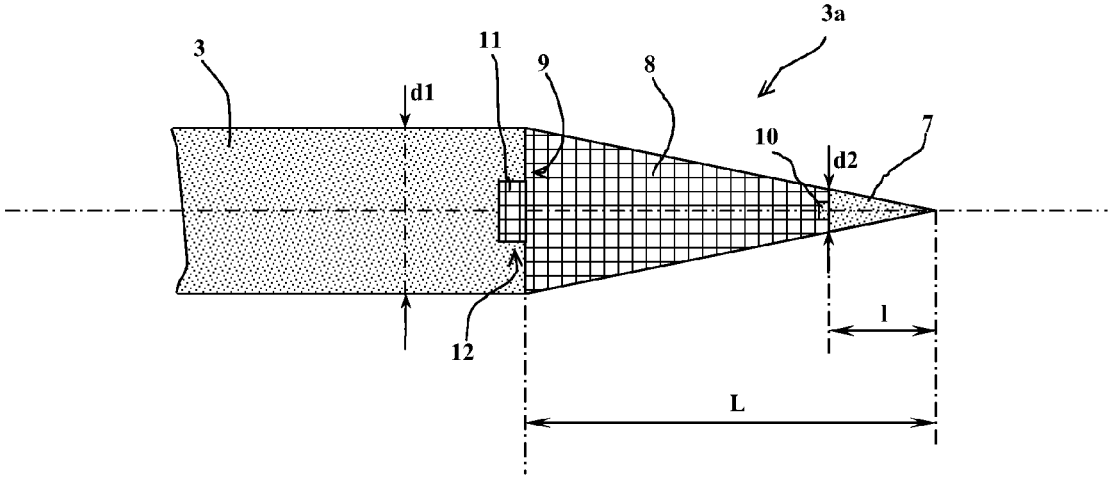
FIG. 6 shows a head structure of a projectile according to a second embodiment of the invention.

FIG. 6 shows another embodiment of the invention which differs from that of FIG. 4 only by the presence of a cylindrical rod 11 at the rear face of the block 8. This rod 11 positions in a bore 12 made at the front face 9 of the bar 3.

Such an arrangement facilitates the assembly of the block 8 onto the bar. However, the fixation of the block 8 to the bar 3 will be ensured by gluing.

Figure 7:
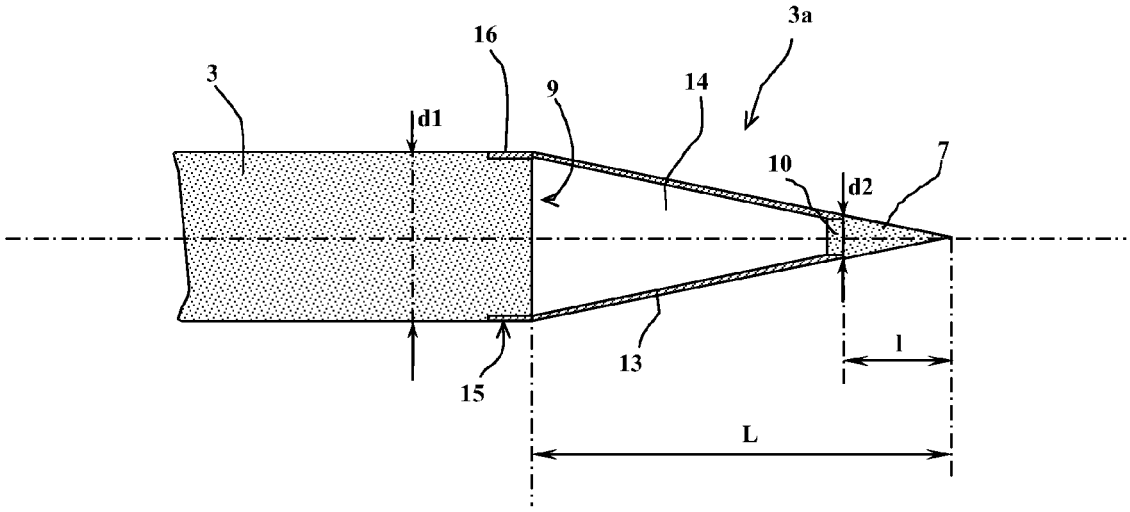
FIG. 7 shows a head structure of a projectile according to a third embodiment of the invention.

FIG. 7 shows another embodiment of the invention wherein the support structure is formed by a sleeve 13 in the shape of a truncated cone made of aluminum. The sleeve 13 is hollow and defines an empty space 14.

The sleeve 13 has a reduced thickness (of the order of the millimeter). One of its functions is to ensure the aerodynamic profile of the projectile for its ballistic trajectory. It also provides the support of the tip 7 which, as in the previous embodiments, is made of a heat resistant material, e.g. of steel or else of a material identical to that of the bar 3, such as a tungsten alloy. The tip 7 provides the resistance to the thermal shock occurring during the flight.

The tip 7 still has a maximum diameter d2 which is less than half the diameter d1 of the bar 3 and extends over a length 1 which is between 20% and 50% the total length L of the conical portion 3*a*.

The sleeve 13 receives at its front portion the lug 10 of the tip 7 which will be able to bear a thread.

The sleeve 13 comprises a cylindrical extension 16 which positions on a choke 15 made at the front end of the bar 3.

Considering the small thickness of the sleeve 13, the diameter reduction of the bar 3 at the choke 15 has a negligible influence on the piercing performances. The sleeve has therefore no ballistic effects on the target (it does not participate in the perforation).

Upon impacting on a target, the tip 7 and the sleeve 13 are ejected or destroyed. It is the bar 3 with its flat front face 9 which impacts the target and creates in it a perforation of a diameter substantially equal to twice d1. This large diameter hole is obtained even with impacts under high indidence. The piercing performances are thus not reduced by the impacts under incidence.

Figure 8:
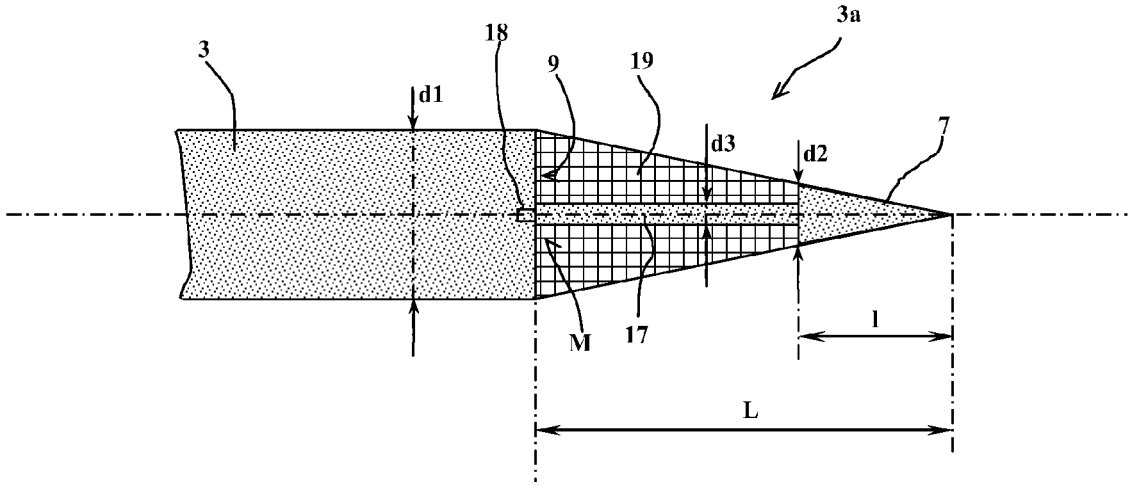
FIG. 8 shows a head structure of a projectile according to a fourth embodiment of the invention.

FIG. 8 shows another embodiment of the invention wherein the support structure of the tip 7 comprises a foot 17 connecting the tip 7 to a middle portion 9 of the front face 9 of the bar. The foot 17 may (as shown herein) be integrally made with the tip 7. It is secured to the bar 3 by a threaded end 18 engaged in a thread carried by the front face 9 of the bar 3.

The foot 17 is surrounded by a tube 19 made of a plastic or ceramic material. This tube has a conical outer profile and the sole function of completing the ballistic warhead of the bar. It does not participate in the perforation and has therefore no ballistic effects. It is destroyed by the impact on the target. The material of the tube 19 may be selected from the materials with a melting temperature greater than 200° C. (same as the support 8 described with reference to FIGS. 4 and 6).

As in the previous embodiments, the diameter d2 of the tip 7 is less than half the diameter d1 of the bar 3.

According to an essential feature of this embodiment, the foot 17 also has a diameter d3 which is less than a quarter of the diameter d1 of the bar.

With such an arrangement, the foot 17 has no ballistic effects on the target.

Upon impact on the target, the tip 7 creates a lead hole the diameter of which is substantially equal to d2, so less than half the diameter d1 of the bar 3.

The front face 9 of the bar 3 impacts the target without being disturbed neither by the foot 17 nor by the tube 19. It results in a hole in the target which is choke free. Here again, the projectile is therefore little sensitive to the impacts under incidence.

SEQUENCE LISTING

Not Applicable

The invention claimed is:

1. An arrow-type sub-caliber projectile comprising a piercing bar which is cylindrical about a longitudinal axis, extended by a conical portion, and surrounded by a sabot made of a lightweight material and allowing the firing of the projectile in a weapon, wherein the conical portion comprises a tip of a heating-resistant material with a maximum diameter less than half the diameter of the bar, the tip being connected to the bar by a support structure having no ballistic effects, the bar comprising a flat front face which is perpendicular to the longitudinal axis of the bar, the flat front face area being substantially equal to the cross-sectional area of the bar, thus with no element with ballistic effects interposed between the flat front face of the bar and the tip.

2. The sub-caliber projectile according to claim 1, wherein the support structure comprises a block made of a plastic or ceramic material.

3. The sub-caliber projectile according to claim 1, wherein the support structure comprises an aluminum conical tubular sleeve.

4. The sub-caliber projectile according to claim 1, wherein the support structure comprises a foot connecting the tip to a middle portion of the front face of the bar, the foot having a diameter less than a quarter of the diameter of the bar.

5. The sub-caliber projectile according to claim 4, wherein the foot is surrounded by a tube of a plastic or ceramic material.

6. An arrow-type sub-caliber projectile configured to be fired in a weapon, the arrow-type sub-caliber projectile comprising:

a piercing bar configured to be: (1) cylindrical along a longitudinal axis, (2) extended by a conical portion, and (3) surrounded by a sabot formed of a lightweight material, the piercing bar including:

a tip of a heating-resistant material having a maximum diameter of less than half the diameter of the piercing bar, the tip being connected to the piercing bar by a support structure having no ballistic effects, and a flat front face area perpendicular to the longitudinal axis of the piercing bar, the flat front face area being substantially equal to the cross-sectional area of the piercing bar, and elements having ballistic effects are not interposed between the flat front face area and the tip.

* * * * *